US006565338B1

(12) United States Patent
Chang et al.

(10) Patent No.: US 6,565,338 B1
(45) Date of Patent: May 20, 2003

(54) COMPRESSOR FIXED TURBINE ASSEMBLY STRUCTURE

(75) Inventors: Lung-Tsai Chang, Hsinchu (TW); Mu-Ching Yeh, Pingjen (TW)

(73) Assignee: Rechi Precision Co., Ltd., Taoyuan (TW)

( * ) Notice: Subject to any disclaimer, the term of this patent is extended or adjusted under 35 U.S.C. 154(b) by 0 days.

(21) Appl. No.: 09/996,411

(22) Filed: Nov. 19, 2001

(51) Int. Cl.[7] ..... F04C 18/04
(52) U.S. Cl. ..... 418/55.1
(58) Field of Search ..... 418/55.1; 29/888.022

(56) References Cited

U.S. PATENT DOCUMENTS 5,407,335 A * 4/1995 Caillat et al. ..... 418/55.1
6,027,321 A * 2/2000 Shim et al. ..... 418/55.1
6,056,524 A * 5/2000 Williams et al. ..... 418/55.1

FOREIGN PATENT DOCUMENTS

JP 5-18202 * 1/1993 ..... 29/888.022

* cited by examiner

*Primary Examiner*—John J. Vrablik
(74) *Attorney, Agent, or Firm*—Pro-Techtor International Services

(57) ABSTRACT

An improved structure for a fixed turbine assembly in a compressor by having provided in the inner edge of a fixation block vertically disposed on the housing, a corresponding second channel in the outer edge of the fixed turbine, and a retainer simultaneously inserted between both channels to restrain and form a link for the fixed turbine and the housing thus to secure the fixed turbine and present it from turning.

1 Claim, 5 Drawing Sheets

COMPRESSOR FIXED TURBINE ASSEMBLY STRUCTURE

BACKGROUND OF THE INVENTION (a) Field of the Invention

The present invention relates to an improved fixed turbine assembly structure in a compressor, and more particularly, to one that effectively reduce deformation due to knocking and is better subject to shear than a positioning pin does.

(b) Description of the Prior Art

A general turbo-compressor generally available in the market is essentially comprised of a circulating turbine, a fixed turbine, a separator and a housing. Within, an upper closed space and a lower closed space inside the compressor respectively form a low-pressure chamber and a high-pressure chamber by the separator. A coolant inlet and a coolant outlet are respectively provided to one side of the LP and the HP chambers. A fixed turbine and a circulating turbine are provided below the separator. The circulating turbine activated by a drive unit revolves around inside the fixed turbine instead of rotating on its own axis to vary space of the fixed turbine in relation to that of the circulating turbine, thus to suck and compress the coolant entering into the LP chamber. The volume of the coolant is changed to execute heat exchange in cycle between a coolant pipe and the compressor.

Whereas the circulating turbine and the fixed turbine are both operating at high speed, a sufficient stability is required by contact between both of said turbines while the fixed turbine is expected to give highly secured positioning purpose. Therefore, a positioning structure is provided between the fixed turbine and the housing to secure the fixed turbine onto the housing without being affected by the operation of the circulating turbine. FIG. 1 of the accompanying drawings of the present invention is a schematic view showing the positioning structure provided between a fixed turbine (A3) and a housing (A1) inside a compressor (A) of the prior art. A circulating turbine (A2) is disposed above the center of the housing (A1) and a pair of fixation blocks (A11) to restrain the outer edge of the fixed turbine (A3) are vertically provided to the outer circumference of the housing (A1). A positioning hole is respectively provided to the fixation block (A11) and the outer edge of the fixed turbine (A3) where both of the housing (A1) and the fixation block (A11) are abutted. A positioning pin (A4) is laterally inserted into where between said two positioning holes to form a limiting structure between the housing (A1) and the fixed turbine (A3) to restrain the rotation of the fixed turbine (A3). However, in the manufacturing process, it is very difficult in the process itself, especially, in lateral insertion of the positioning pin. The reason is that an indexing plate is required to rotate the positioning hole to complete two rounds of drilling work, making it difficult to align the central lines of both positioning holes, resulting in poor quality control and higher NG percentage.

As illustrated in FIG. 2 showing another prior art of the present invention, a fixation block (A11') is laterally provided. A section substantially in the form of an ear laterally formed in relation to a outer edge of a fixed turbine (A3') is attached to the fixation block (A11'). A positioning pin (A4') is then longitudinally inserted and secured between the fixed turbine (A3') and the fixation block (A11') from the housing. Whereas the positioning pin (A4') has to pass one positioning hole, then is knocked into another positioning hole, precision of parts is damaged and the contact area between the positioning hole and the positioning pin is deformed under the pressurized stress created by the knocking. The positioning pin even breaks up for being frequently subject to shear in radius, thus fails to secure the fixed turbine in position.

SUMMARY OF THE INVENTION

The primary purpose of the present invention is to provide an improved structure for a fixed turbine assembly in a compressor. Wherein, a first channel is formed in the inner edge of a fixation block vertically provided on the housing, and a corresponding second channel is provided in the outer edge of a fixed turbine for a retainer to be inserted into both channels. The retainer functions to restrain the link between the fixed turbine and the fixation block from the housing, so to hold the fixed turbine in position.

Another purpose of the present invention is to provide an improved structure for a fixed turbine assembly in a compressor. To minimize potential distortion of precision or deformation due to knocking during the process, the retainer is inserted into the first and the second channels respectively in the inner edge of the fixation block and in the outer edge of the fixed turbine to simultaneously secure the retainer and both channels.

Another purpose of the present invention is to provide an improved structure for a fixed turbine assembly in a compressor. Wherein, a fast link between the fixed turbine and the housing is achieved by having the retainer inserted between the first and the second channels respectively from the inner edge of the fixation block and the outer edge of the fixed turbine to hold both of the fixation block and the fixed turbine in place, and to form a structure which is better capable of withstanding the shear thus to help hold the fixed turbine in position and improve its workability.

DETAILED DESCRIPTION OF THE PREFERRED EMBODIMENTS

Figure 1:
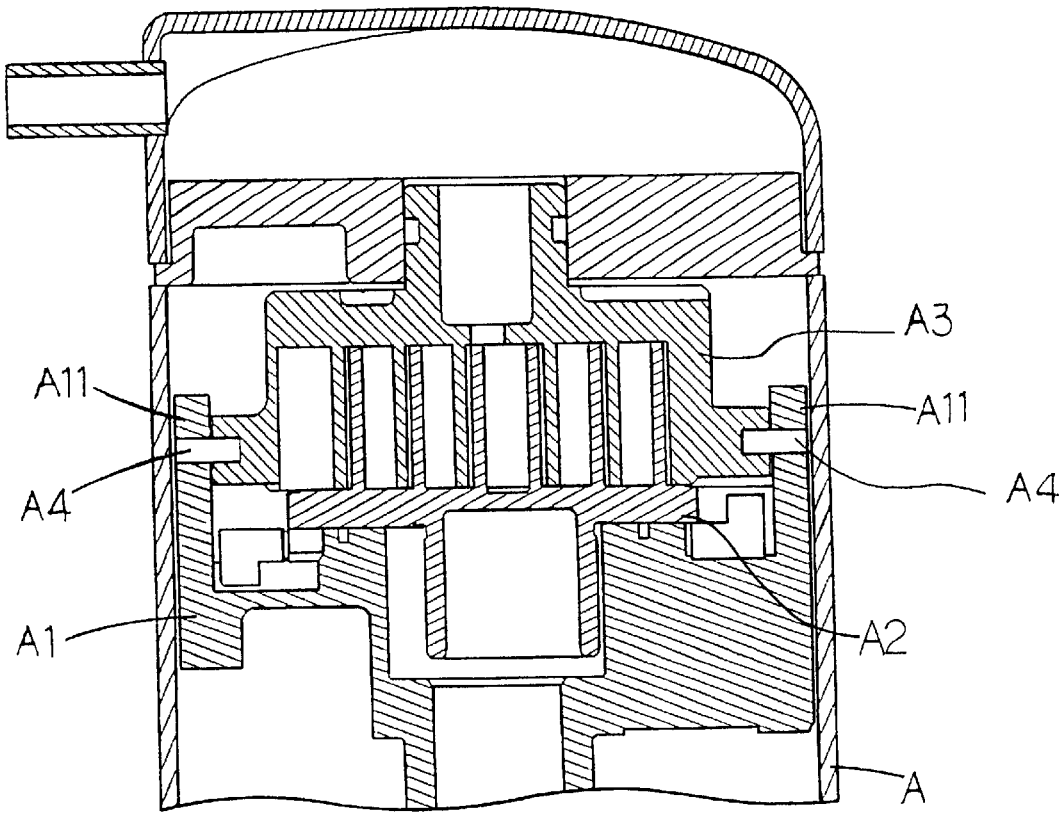
FIG.1 Prior Art
FIG. 1 is a schematic view showing a structure of a turbine compressor of the prior art.
Figure 2:
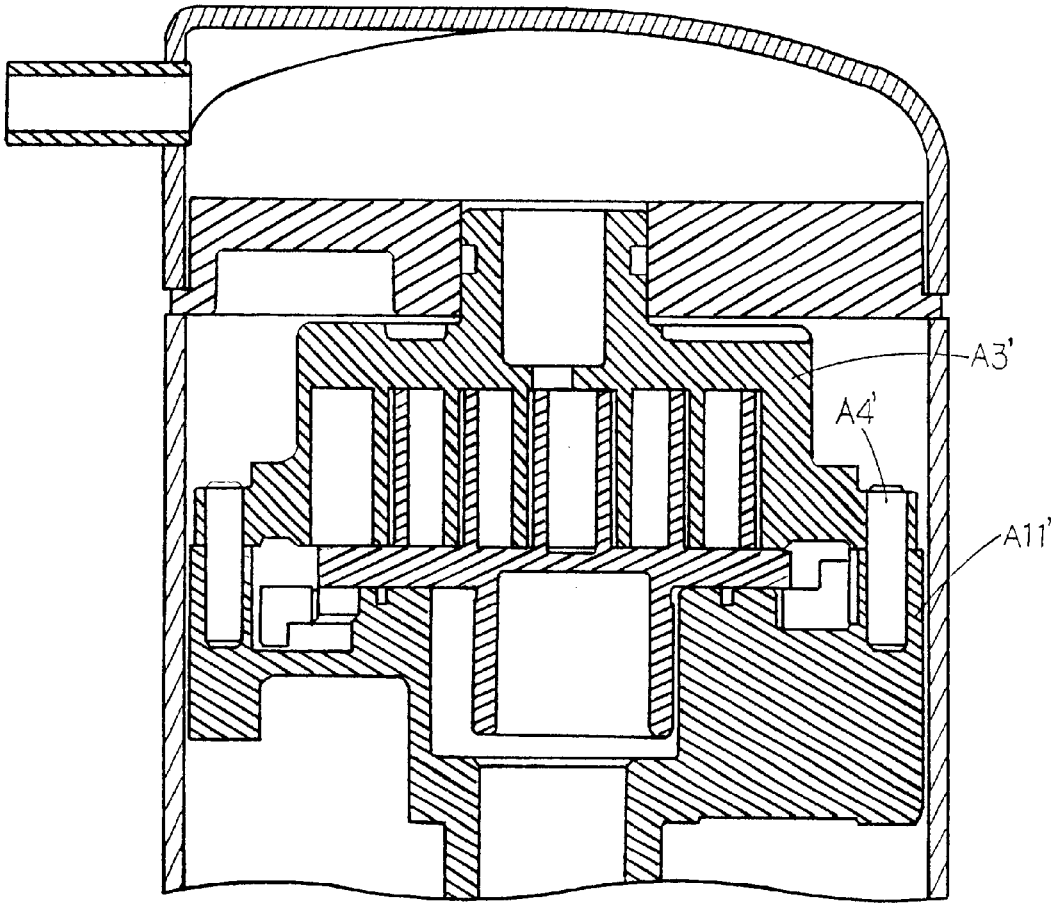
FIG.2 Prior Art
FIG. 2 is a schematic view showing another structure of a turbine compressor of the prior art.
Figure 3:
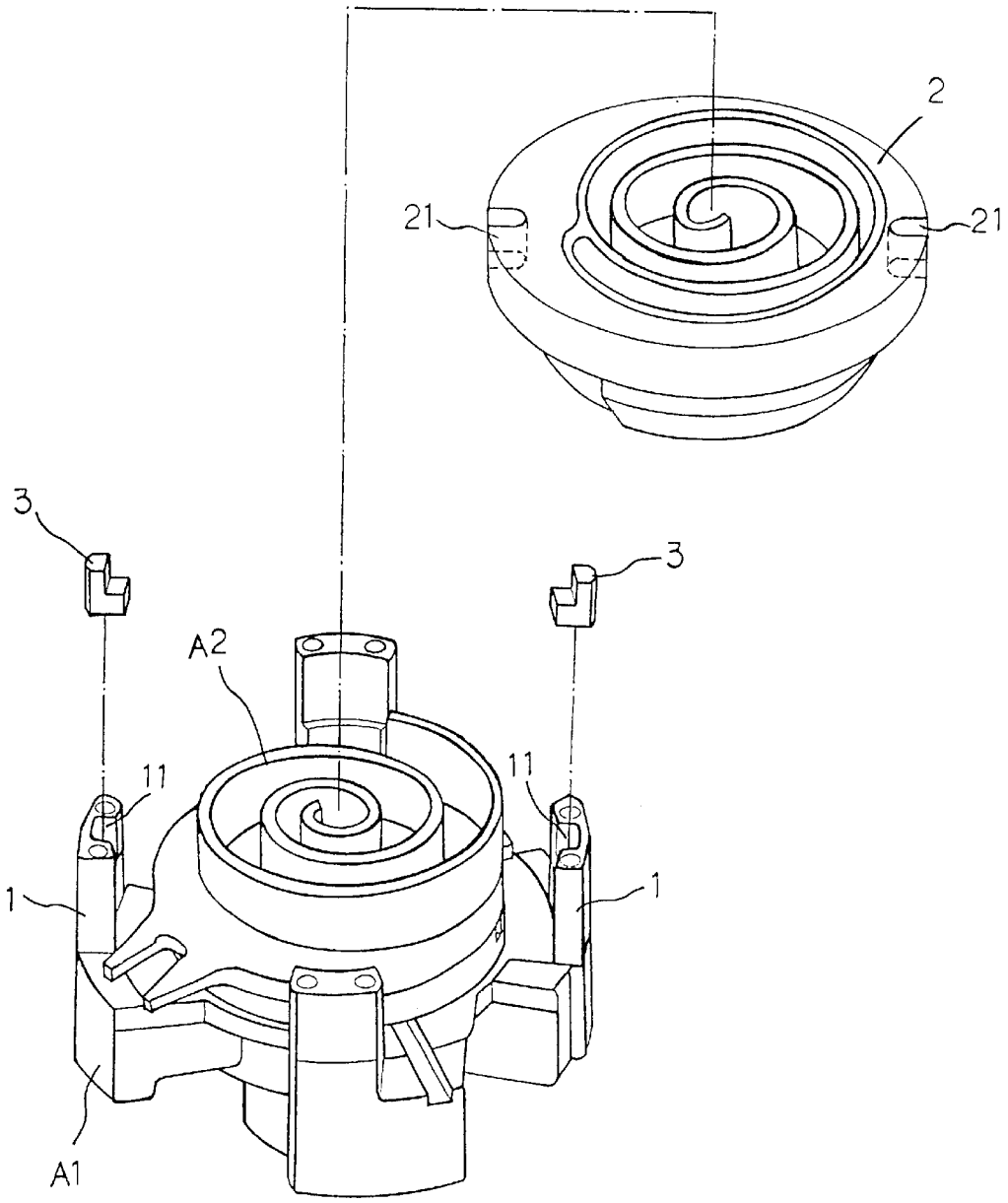
FIG. 3 is an exploded view of a preferred embodiment of the present invention.
Figure 4:
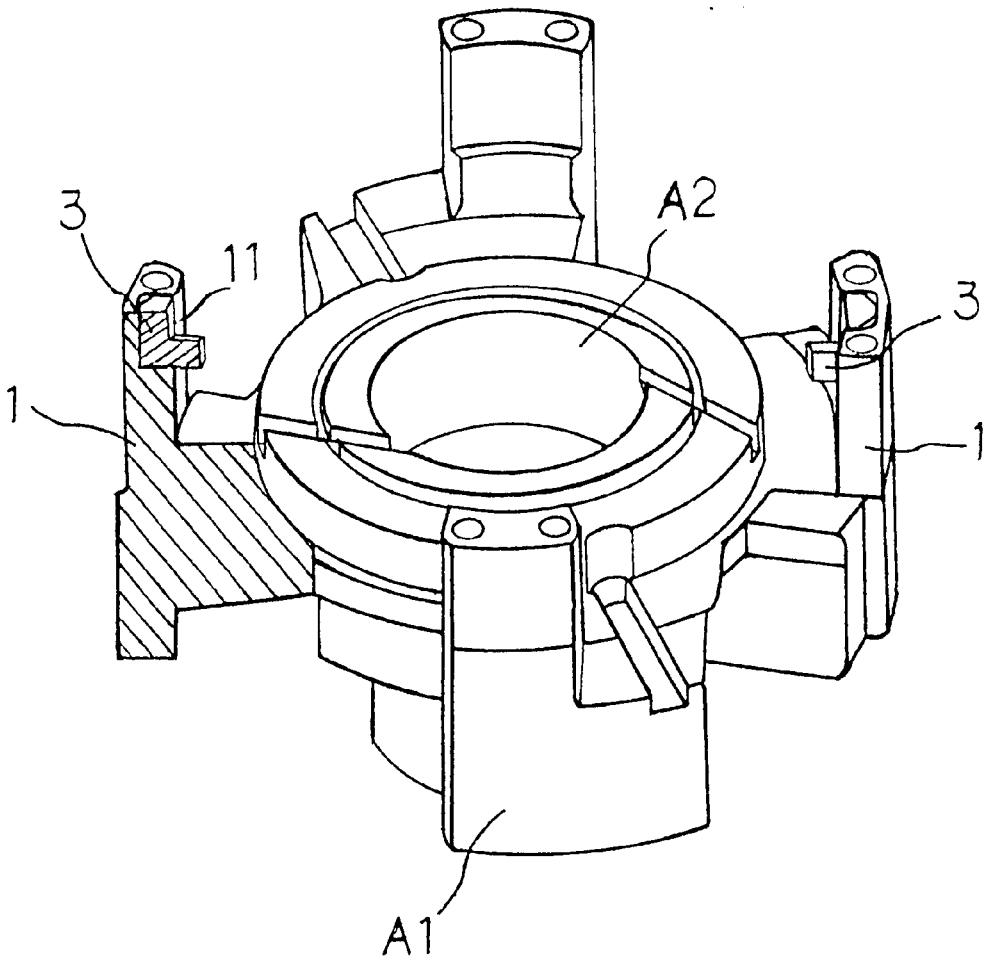
FIG. 4 is a sectional view of an insertion structure between a retainer and a fixation block of the preferred embodiment of the present invention.

An improved structure for a fixed turbine assembly in a compressor of the present invention is essentially related to a positioning link between a fixed turbine and a housing inside the compressor to prevent the fixed turbine from turning together with the circulating turbine when the compressor is operating. As illustrated in FIG. 3, the fixed turbine (2) is placed above the housing (A1) to be engaged with a circulating turbine (A2) disposed on the center of the housing (A1). A fixation block (1) is vertically provided on the outer circumference of the housing (A1) to restrain the outer edge of the fixed turbine (2) to form a section for linking the housing (A1) and the fixed turbine (2).

Figure 5:
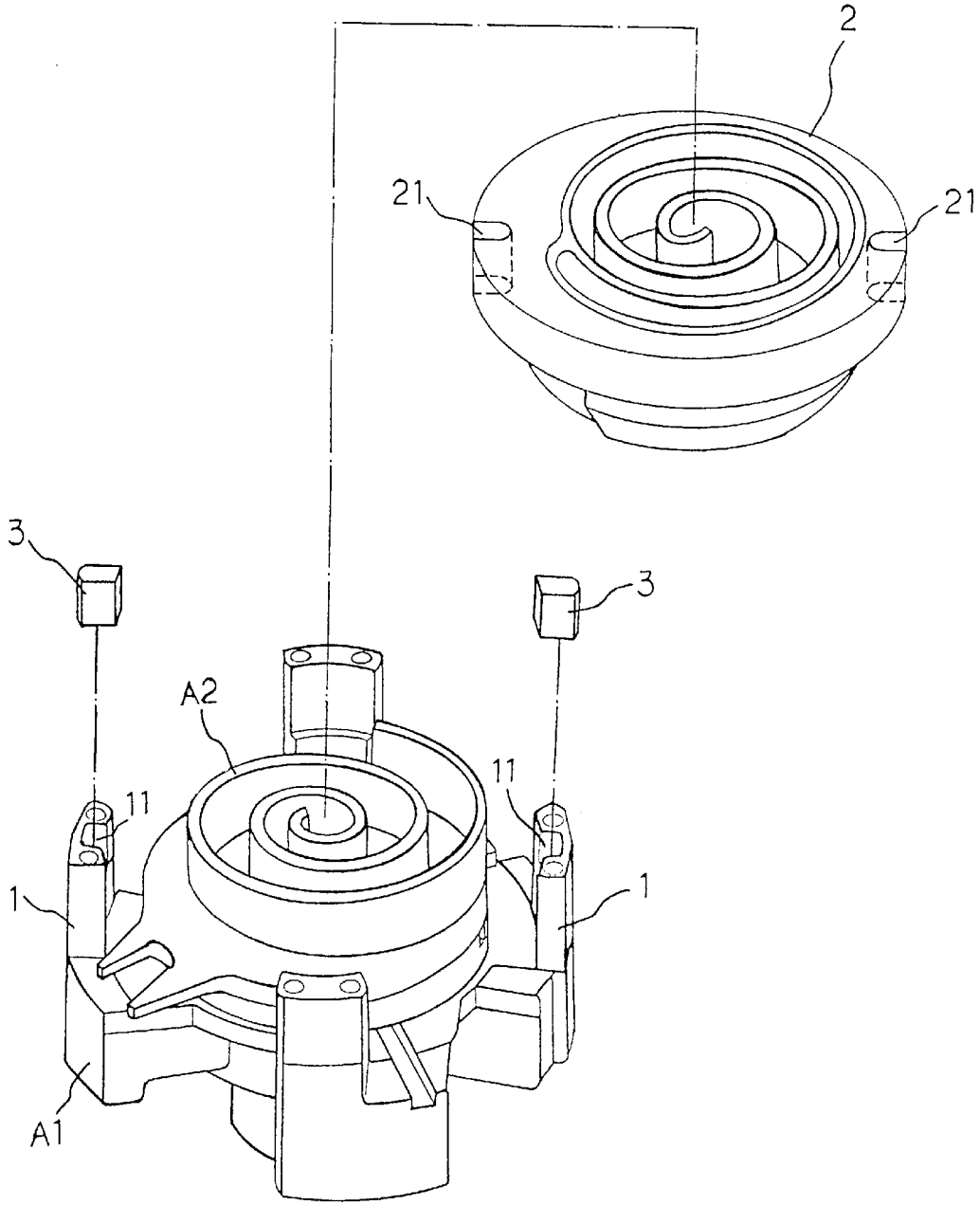
FIG. 5 is an exploded view of another preferred embodiment of the present invention.

Referring to FIGS. 3 and 5, a first channel (11) is vertically provided in the inner edge of the fixation block (1) and a corresponding second channel (21) is provided in the outer edge of the fixed turbine (2). A retainer (3) simultaneously inserted into the first and the second channels (11, 21) to restrain and to form a link between the fixed turbine (2) and the fixation block (1) on the housing (A1). The fixed turbine (2) is fast held in position and prevented from turning. Since the retainer (3) is vertically inserted into the same vertically disposed first and second channels (11, 21) and subject to axial sheath, it is more capable of withstanding the sheath. Furthermore, the retainer (3) permits a reduced section required to be engaged with the second channel (21); in turn, it improves the assembly convenience between the retainer (3) and the fixed turbine (2) while maintaining sufficient support strength.

As illustrated in FIG. 5, the retainer (3) is made in the form with its insertion section identical to the first and the second channels (11, 21) to maintain optimal structure strength. Upon assembling the fixed turbine (2) and the fixation block (1) from the housing (A1), the retainer (3) is inserted at the same time into the first and the second channels (11, 21) respectively provided in the inner edge of the fixation block (1) and the outer edge of the fixed turbine (2). The retainer (3) and both of the first and the second channels (11, 21) are secured altogether to effectively minimize possible distorted precision or deformation due to knocking and processing.

The present invention by having vertically provided the first channel in the inner edge of the fixation block, the corresponding second channel in the outer edge of the fixed turbine, and the retainer inserted between said two channels to restrain and form a link section for the fixed turbine and the fixation block from the housing to secure the fixed turbine from turning, offers a preferred positioning structure for a fixed turbine in a turbo-compressor. Therefore, this application for a utility patent is duly filed accordingly.

We claim:

1. An improved structure of a fixed turbine assembly in a compressor comprising:

a housing comprising at least two fixation blocks at an outer portion of said housing, each said fixation block having a first channel formed in an inner surface of said fixation block, a circulating turbine disposed within said housing, a fixed turbine affixed to said housing, said fixed turbine having a pair of second channels formed in an outer surface of said fixed turbine and corresponding in position to said first channels of said housing, at least two retainers having an L-shaped cross section; wherein said first channels and said second channels form positioning structures open to a top side of said turbine assembly, each said positioning structure receiving a corresponding one of said retainers, a vertical segment of said retainers being received in said first channels and a horizontal segment of said retainers being received in said second channels; such that said circulating turbine rotates within said housing and said fixed turbine, and said fixed turbine cannot rotate relative to said housing.

* * * * *